United States Patent [19]

Chien

[11] Patent Number: 4,743,714

[45] Date of Patent: May 10, 1988

[54] MULTIPLE PUSHBUTTON SWITCH AND INTERLOCK ASSEMBLY

[76] Inventor: Hai-Yuan Chien, 81, Hsien Ho Street, Taichung, Taiwan

[21] Appl. No.: 60,332

[22] Filed: Jun. 10, 1987

[51] Int. Cl.[4] ..... H01H 9/20

[52] U.S. Cl. ..... 200/5 E; 200/5 EA

[58] Field of Search ..... 200/5 E, 5 EA, 5 EB, 200/50 C

[56] References Cited

U.S. PATENT DOCUMENTS

| | | | |
|---|---|---|---|
| 3,271,530 | 9/1966 | Wirsching | 200/5 EA |
| 3,476,890 | 11/1969 | Powell | 200/5 EA |
| 3,719,786 | 3/1973 | Mallett et al. | 200/5 EB |
| 3,780,236 | 12/1973 | Gross | 200/5 EA |

*Primary Examiner*—J. R. Scott

*Attorney, Agent, or Firm*—Cushman, Darby & Cushman

[57] ABSTRACT

A multiple pushbutton switch comprising a lower insulative housing; a cover member mounted over the housing to form an accommodating space; a plurality of equally spaced selecting contact plates retained by the housing; a plurality of equally spaced J-shaped contacting springs accommodated by the housing and a second arm of each contacting spring is in alignment with the selecting contact plate; an L-shaped contact plate positioned in the housing with a first plate contacted with the first arms of each J-shaped contacting springs; a plurality of pushbuttons positioned within the housing to cause the closing and/or opening of one or more pair of contacts when any of the pushbuttons are depressed in their downward positions and an interlock engaging mechanism movably fixed within the accommodating space is capable of latching the depressed pushbutton in a downward position and prevent the simultaneous depression of more than one pushbutton.

8 Claims, 3 Drawing Sheets

MULTIPLE PUSHBUTTON SWITCH AND INTERLOCK ASSEMBLY

BACKGROUND OF THE INVENTION

This invention relates to a pushbutton switch and particularly to an improved multiple pushbutton switch to reduce the manufacturing cost.

Multiple pushbutton switches have been used in great numbers as appliance switches in electric ranges so as to control the circuitry thereof. However, conventional multiple pushbutton switches are complicated to manufacture and troublessome to assemble because most component parts of the switches are made of metal plate.

SUMMARY OF THE INVENTION

An object of this invention is to provide a multiple pushbutton switch which can be manufactured and assembled easily to economize the cost.

This and other objects of this invention are achieved in an illustrative embodiment thereof wherein the multiple pushbutton switch comprises a lower insulative housing having a base and four walls extending upwardly from the base. The base has a plurality of equally spaced guiding groove couples, supporting members, wire holes and retaining members therein. The front wall and rear walls have a plurality of equally spaced pillars extending upwardly from their top edges, and each pillar has a laterally extending hook portion.

A plurality of pushbuttons are positioned within the housing. Each pushbutton has a pushrod with a head portion on its top end and a stopping block on its bottom end. The stopping block has an actuating bar and a separating bar respectively extending laterally from the rear surfaces and side surface. The stopping block also has two legs extending downwardly therefrom, each leg being disposed about a guiding groove couple and movable along the length thereof.

A plurality of selecting contact plates are retained in the housing. Each selecting contact plate has a rectangular plate with an L-shaped mounting portion extending from its top end to secure it on an associated supporting member.

A plurality of J-shape contacting springs having first and second arms are also accomodated in the housing. A first arm of each contacting spring has an engaging portion secured on a retaining member and a second arm of each contacting spring having a contact portion in alignment with the rectangular plate of the selecting contact plate.

An L-shaped contact plate is positioned with in the housing, a first plate of the contact plate is contacted by the first arms of each J-shaped contacting spring and the second arm of the contact plate exposed through the housing.

A cover member is mounted over the lower insulative housing, the cover member having a plurality of apertures in the upper surface thereof through which the pushrods of the pushbuttons normally extend. A plurality of equally spaced indentations are provided on the front edge and rear edge of said cover member so as to secure it to the hook portions of said pillars.

An interlock engaging mechanism is movably fixed within the housing and capable of latching said depressed pushbuttons so as to maintain a selected contact plate and a J-shaped contacting spring in contacting position.

BRIEF DESCRIPTION OF THE DRAWINGS

This invention will be more fully understood from the following detailed description, taken in connection with the accompanying drawing which form an integral part of this application.

DESCRIPTION OF THE PREFERRED EMBODIMENT

Figure 1:
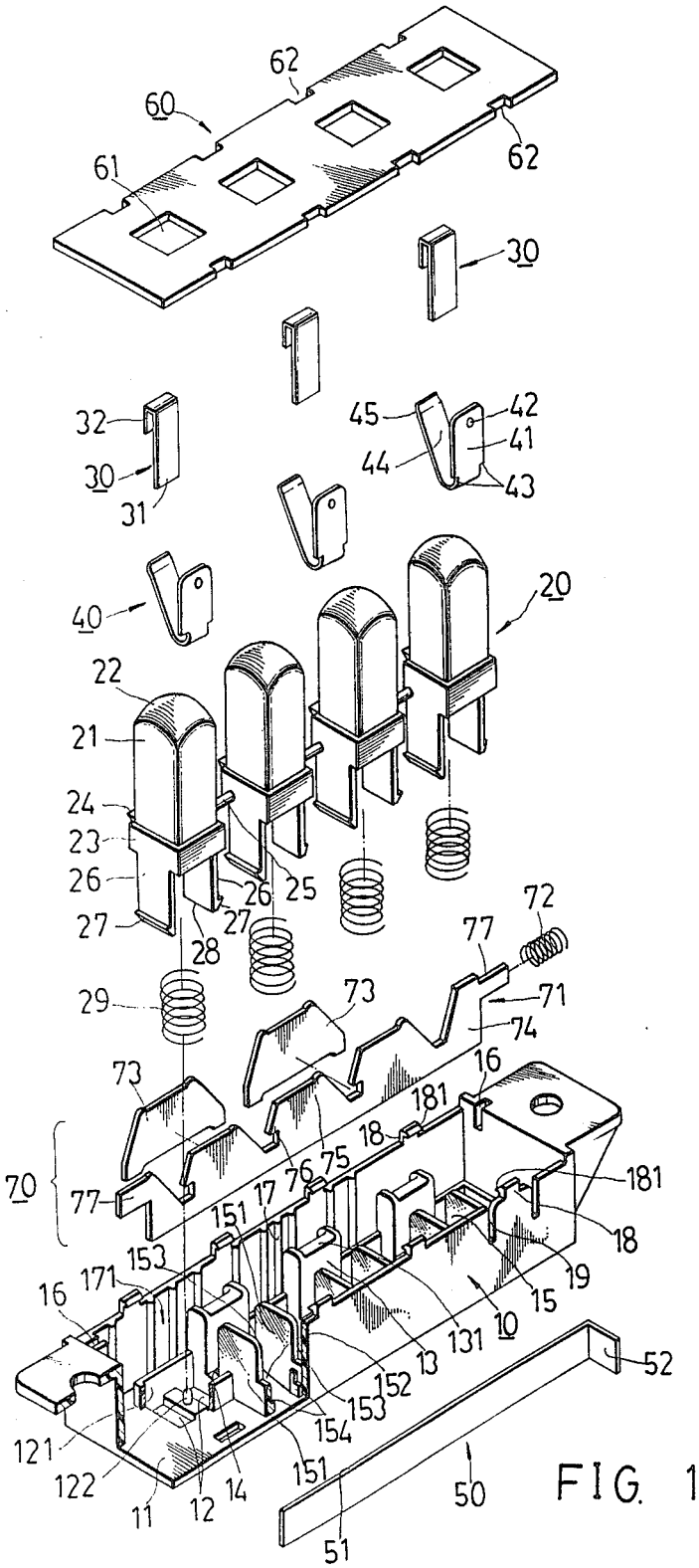
FIG. 1 is an exploded perspective view of a multiple pushbutton switch in accordance with one preferred embodiment of this invention.
Figure 2:
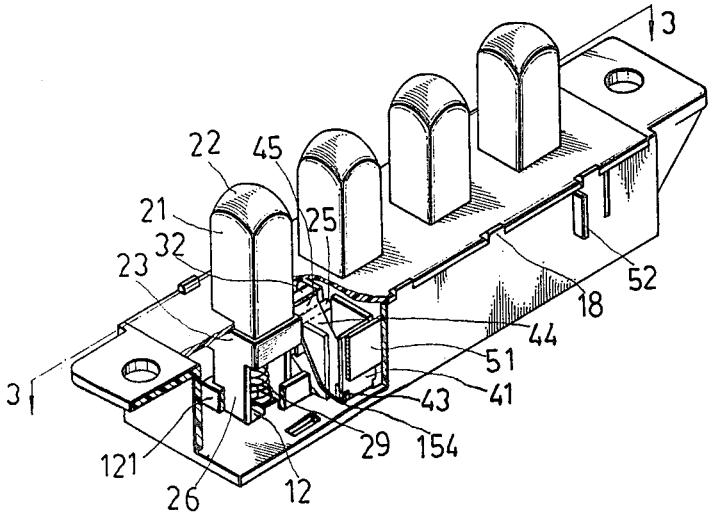
FIG. 2 is a perspective view of an assembled multiple pushbutton switch from FIG. 1, with a cut away for illustration purpose.
Figure 3:
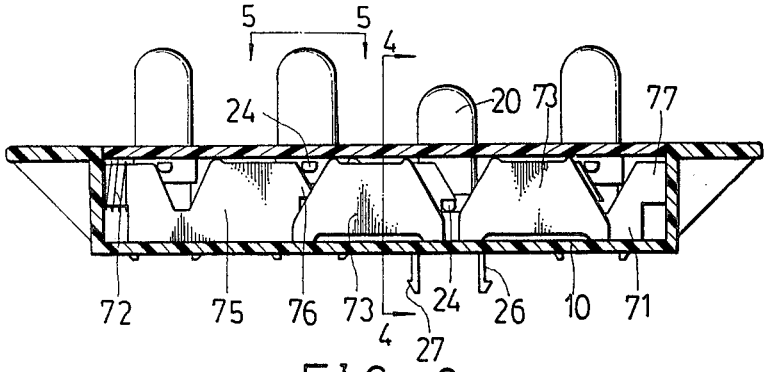
FIG. 3, is a cross-sectional view taken along line 3—3 of FIG. 2.

Referring to FIGS. 1 and 2, the multiple pushbutton switch of this invention includes a lower insulative housing 10 comprising a generally planar base portion 11 having four walls extending upwardly therefrom and generally normal thereto. The base portion 11 has a plurality of equally spaced guiding groove couples 12, supporting members 13, wire holes 14, and retaining members 15 extending upwardly therein. Each guiding groove couple 12 has a fence 121 extending upwardly from the surround and a pin 122 surrounded by said fence 121. Each supporting member 13 has a rectangular pillar extending upwardly from the base portion and adjacent to the wire hole 14. An opening 131 is provided on the upper surface of said rectangular pillar. Each retaining member 15 includes two parallel walls 151 and a curved bottom 152 extending upwardly from the base portion 11 with one side being contiguous with the front wall of housing 10 to form an accommodating space. Each parallel wall 151 has a ditch 153 provided on a top edge, and two L-shaped engaging blocks 154 symmetrically provided on the inner surface of a pair of parallel walls. The ditches 153 are aligned in a row adjacent to the front wall of the housing 10. The side walls of the housing 10 have two opposite sliding slots 16 respectively provided on the inner surface of the housing. The rear wall of the housing 10 has a plurality of protrusions 17 extending outwardly from the inner surface thereof to form a retaining seat 171. The rear wall and the front wall of the housing 10 have a plurality of equally spaced pillars 18 respectively extending upwardly from their top edges. Each pillar 18 includes a laterally extending hook portion 181 having an inclined upper surface and a horizontal undersurface. The front wall of the housing 10 also has a slit 19 provided on its top edge and generally transverse to the row of ditches 153.

A pushbutton 20 is inserted into each guiding groove couple 12 of the housing 10. Each pushbutton 20 comprises a rectangular pushrod 21 having a head portion 22 on its top end and a stopping block 23 situated on its bottom end. The stopping block 23 has an actuating bar 24 and a separating bar 25 respectively extending laterally from its rear surface and side surface, and two parallel legs 26 extending downwardly from an underface of said stopping block 23. Each leg 26 has a hook portion 27 extending laterally from its bottom end, and a recess 28 formed between said two parallel legs 26. The two parallel legs 26 are inserted into the guide groove couple 12 and a spring 29 is disposed about each pin 122 of housing 10 intermediate the pushbutton 20 and the base portion 11 of the housing 10, each spring 29 acting to bias the associated pushbutton upwardly.

A plurality of selecting contact plates 30 are retained by the supporting members 12 of the housing 10. Each selecting contact plate 30 has a rectangular plate with its bottom end 31 exposed through wire hole 14, and an L-shaped mounting portion 32 extending laterally from the top end of the rectangular plate secured on opening 131 of supporting member 13.

A plurality of J-shaped contacting springs 40 are accommodated by the retaining members 15 of the housing. A first arm 41 of each contacting spring 40 includes a protuberance 42 and an engaging portion 43. The second arm 44 of each contacting spring 40 includes a contact portion 45. The engaging portion 43 is secured on two symmetrically L-shaped engaging blocks 154 of the retaining member 15. The contact portion 45 is placed in alignment with the rectangular plate of the selecting contact plate 30.

An L-shaped contact plate 50 positioned in the ditches 153 of each retaining member 15 and slit 19 of the housing 10. The first plate 51 of the contact plate 50 contacts the protuberances 42 of each J-shaped contacting spring 40. The second plate 52 of the contact plate 50 is exposed through slit 19.

A cover member 60 is mounted over the housing 10. The cover member 60 includes a plurality of equally spaced apertures 61 in the upper surface thereof through which the pushrods 21 of the pushbuttons 20 are normally extended. The cover member 60 further includes a plurality of equally spaced indentations 62 provided on its front edge and rear edge so as to secure itself on the hook portions 181 of the pillars 18.

An interlock engaging mechanism 70 made up of a latch bar 71, a spring member 72, and a plurality of lockouts 73 is movably fixed within the housing 10. The latch bar 71 comprises an elongated bar portion 74 having a plurality of equally spaced upright portions 75 extending upwardly therefrom. All but the left-hand and right-hand upright portions 75 have laterally extending nose portions 76. The upper surface of each nose portion 76 is inclined and the lower surface thereof is generally horizontal. The latch bar 71 further includes two finger portions 77 respectively extending outwardly from left-hand and right-hand upright portions 75 to insert into the sliding slots 16 of the housing 10. The spring member 72 is disposed about right-hand finger portion 77 and is compressed between finger portion 77 and a side wall of the housing 10, and biases the latch bar 71 to the left.

In this position of the latch bar 71, each nose portion 76 underlies an actuating bar 24 extending laterally from the stopping block 23 of the pushbutton 20. When one of the pushbuttons 20 is depressed, the actuating bar 24 engages the latch bar 71 toward the right side ledge of the housing 10. The actuating bar 24 continues to deflect the latch bar 71 to the right until the actuating bar moves past the end of the inclined surface of the nose portion 76. When this occurs, the spring member 72 returns the latch bar 71 to its position against the left side ledge of the housing 10, and the horizontal surface of the nose portion 76 is moved over the actuating bar 24, latching the pushbutton in a downward position.

When a second pushbutton 20 is depressed, the latch bar 71 is again deflected to the right, and when the actuating bar 24 of the second pushbutton 20 reaches the end of the inclined surface of the associated nose portion 76, the latch bar 71 is deflected to a position wherein the actuating bar 24 of the first pushbutton 20 is no longer beneath the horizontal surface of its associated nose portion 76. The spring 29 associated with the first pushbutton 20 thereupon moves the pushbutton 20 to its upward position.

Figure 4:
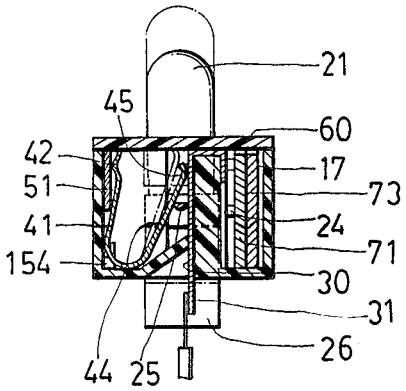
FIG. 4 is a cross-sectional view taken along line 4—4 of FIG. 3.
Figure 5:
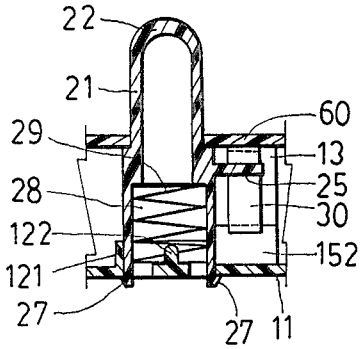
FIG. 5 is a cross-sectional view taken along line 5—5 of FIG. 3.

When the pushbutton 20 on the far right is moved to its downward position, it is not latched in that position, and as it returns to its upward position, it releases any previously latched pushbutton. In addition, as heretofore set forth herein, when any of the pushbuttons 20 are in their respective downward positions, the second arm 44 of the J-shaped contacting spring 40 interacts with the selecting contact plate 30 in the manner shown in FIG. 4 to cause the closing of one pair of contacts. When any of the pushbuttons 20 are in their respective upward positions, the separating bar 25 is interposed between the second arm 44 of the J-shaped contacting spring 40 and the selecting contact plate 30 to cause the opening of one pair of contacts.

The lockouts 73, which are located between the retaining seat 171 of the housing 10, serve to prevent the simultaneous depression of more than one pushbutton. The lockouts 73 comprise generally triangular shaped planar members. The bases of the lockouts rest on and are movable along the base of the housing 10.

What is claimed is:

1. A multiple pushbutton switch comprising:

a lower insulative housing including a generally planar base portion, having four walls extending upwardly therefrom and generally normal thereto, and having a plurality of equally spaced guiding groove couples, upright supporting members with wire holes and retaining members also located thereon extending normal to said base portion, two opposite sliding slots respectively provided on inner surfaces of a first pair of left and right opposite walls of said four walls, and a retaining seat provided on an inner surface of a rear wall of said four walls, and a slit provided on a top edge of a front wall of said four walls;

an interlock engaging mechanism including a latch bar comprising an elongated member having a plurality of equally spaced upright portions and haviing all but the left-hand and right-hand-most upright portions including a laterally extending nose portion, each said nose portion having an inclined upper surface and a generally horizontal undersurface, a spring member for biasing said latch bar toward one of said sliding slots of said housing, a plurality of lockouts positioned on said retaining seat of said housing, each lockout comprising a generally triangularly shaped planar member, the base of said lockout resting on and being movable along the base of said housing;

a plurality of pushbuttons each having a pushrod, each pushrod having a head portion on its top end and a stopping block adjacent to its bottom end and two legs extending downwardly from an undersurface of said stopping block, each leg having a hook portion on its bottom end and a recess formed between said two legs, an actuating bar and a separating bar respectively extending laterally from the rear surface and side surface of said stopping block;

a spring disposed about each said recess of said pushbutton intermediate the stopping block thereon and the base of said housing, each spring member biasing its associated pushbutton upwardly;

a plurality of selecting contact plates each having a mounting portion secured on one of said supporting members of said housing;

a plurality of J-shaped contacting springs, a first arm of each contacting spring having an engaging portion secured on one of said retaining members and a second arm of each contacting spring having a contact portion which is in alignment with an associated one of said contact plates;

an L-shaped contact plate positioned within said retaining members and slit of said housing, a first plate of said L-shaped contact plate contacting the first arms of each of said J-shaped contacting springs and the second plate of the contact plate exposed through said slit;

a cover member mounted on said lower insulative housing, said cover member having a plurality of apertures located in an upper surface thereof through which the pushrods of said pushbuttons normally extend.

2. A switch as in claim 1, further comprising:

a fence portion extending upwardly from beside each guiding groove couple and generally normal to the base portion of said housing.

3. A switch as in claim 1 wherein:

each of said supporting members comprises a rectangular pillar extending upwardly from said base portion adjacent to one of said wire holes, and an opening provided in an upper surface of said rectangular pillar; said selecting contact plate having a rectangular portion with an L-shaped mounting member extending from the top end thereof to securely engage said opening in each of said supporting members.

4. A switch as in claim 3 wherein: each of said retaining members comprises two parallel walls extending upwardly from said base portion with one side of each wall being contiguous with said front wall of said housing so as to form an accommodating space, and a ditch being provided along a top edge of each parallel wall.

5. A switch as in claim 4 wherein:

a curved bottom portion extends from said base with two sides adjacent to said two parallel walls.

6. A switch as in claim 4 wherein:

two L-shaped engaging blocks are symmetrically provided on the inner surfaces of said two parallel walls.

7. A switch as in claim 1 further comprising:

a plurality of equally spaced pillars extending upwardly from the top edges of said front and rear walls of said housing, each pillar including a laterally extending hook portion having an inclined upper surface and a horizontal undersurface with a plurality of equally spaced indentations provided on front and rear edges of said cover member so as to secure the hook portions of said pillars.

8. A switch as in claim 1 wherein:

a plurality of protrusions extend outwardly from inner surface of said rear wall of said housing to form said retaining seat.

* * * * *